US005699842A

United States Patent [19]

Wegman

[11] Patent Number: 5,699,842

[45] Date of Patent: Dec. 23, 1997

[54] MAGNETIC FILLING AND MIXING APPARATUS AND PROCESSES THEREOF

[75] Inventor: Paul M. Wegman, Pittsford, N.Y.

[73] Assignee: Xerox Corporation, Stamford, Conn.

[21] Appl. No.: 631,485

[22] Filed: Apr. 12, 1996

[51] Int. Cl.[6] ..... B65B 1/04; B65B 3/00; B67C 3/00

[52] U.S. Cl. ..... 141/369; 141/2; 141/18; 141/DIG. 1; 399/254; 399/262; 366/273

[58] Field of Search ..... 141/2, 18, 364, 141/369, DIG. 1; 399/254, 255, 262, 263; 209/609, 636; 222/DIG. 1; 366/273, 274

[56] References Cited

U.S. PATENT DOCUMENTS

| | | | |
|---|---|---|---|
| 3,219,318 | 11/1965 | Hershler | 366/273 |
| 3,892,908 | 7/1975 | Loveness | 366/273 |
| 4,465,111 | 8/1984 | Nalbach | 141/DIG. 1 |
| 4,932,355 | 6/1990 | Neufeld | 118/652 |
| 5,294,022 | 3/1994 | Earle | 141/DIG. 1 |
| 5,306,592 | 4/1994 | Saha | 430/137 |

*Primary Examiner*—Renee S. Luebke
*Assistant Examiner*—Timothy L. Maust
*Attorney, Agent, or Firm*—John L. Haack

[57] ABSTRACT

A process for filling and dispersing the contents of a container, comprising: placing a container to be filled in filling relationship with a container holder and at least one material source; moving a magnetic material from a first source to the container to fill the container with the magnetic material, and applying a magnetic field to the container; moving a non magnetic material from a second source to the container to further fill the container with the non magnetic material; and removing the magnetic field applied to the container prior to discharging the filled material.

17 Claims, 2 Drawing Sheets

MAGNETIC FILLING AND MIXING APPARATUS AND PROCESSES THEREOF

CROSS REFERENCE TO COPENDING APPLICATIONS AND RELATED PATENTS

Reference is made to commonly assigned copending applications: U.S. Ser. No. 08/540,993 (D/95051), filed Nov. 12, 1995, entitled "ELECTROMAGNETIC VALUE AND DEMAGNETIZING CIRCUIT" which discloses a method for controlling filling a container, comprising: placing a first container to be filled in filling relationship to a fill tube; moving a magnetic material from a source thereof through the fill tube to fill the first container with the material; applying a magnetic force to the material in the fill tube once the first container is filled, the magnetic force being sufficient to hold the material in place in the fill tube; removing the first container; placing a second container to be filled in filling relationship to the fill tube; and removing the magnetic force applied to the material so that the material can move through the fill tube and into the second container.

Attention is directed to commonly owned and assigned U.S. Pat. No. 4,499,166, which discloses a developer mixture used in an electrophotographic printing machine to develop an electrostatic latent image including weakly magnetically attractable toner particles and strongly magnetically attractable carrier granules adhering triboelectrically to one another, and wherein the particles and the granules are substantially the same size; and U.S. Pat. No. 5,424,160 which discloses a carrier composition comprised of a magnetic core with a coating thereover comprised of a conductive polymer and a fluoropolymer host resin.

The disclosures of each of the aforementioned documents including all the copending applications are totally incorporated herein by reference.

BACKGROUND OF THE INVENTION

This invention relates generally to an apparatus and processes thereof for filling container with developing material and non invasively mixing the container contents. More particularly, the present invention concerns a filling, distribution, and dispersion system, in embodiments, for magnetic two component developers which provides predispersion of particles, for example carrier particles, in a developer container and promotes uniform dispersion of a developer composition formed when the toner particles are combined with carrier particles.

In large scale mechanized developer manufacture, and specifically in developer container filling operations, typically dense metallic carrier particles are first added to a container or dispensing cartridge in a predetermined amount followed by the addition of a predetermined amount of less dense toner particles. A related container filling operation involves combining in a magnetic toner with a non magnetic toner composition.

A problem frequently encountered with the resulting developer is that an inhomogeneous mixture is obtained. Another problem encountered with the resulting developer is a tendency or propensity of the developer components with a greater density to settle and or separate from components with lesser density during subsequent handling, such as conveying, packaging, shipping, and the like operations. The abovementioned problems may result in non uniform or poor developer performance when used, for example xerographically, or may require an additional developer mixing step or steps, for example mechanical agitation, during developer manufacture, such as, before, during or after the container is filled, or prior to end use. Additional manipulation and handling can lead to situations of end user inconvenience and dissatisfaction, and additional costs and reduced throughput in developer manufacture, and which situations are preferably avoided.

The aforementioned developer inhomogenity, although not desired to be limited by theory, is believed to be attributable at least in part to the first added dense, component, such as carrier particles, residing substantially on the bottom of the fill container and the inability of the carrier particles to achieve adequate mixing with the less dense toner particles when the toner particles are subsequently added to the container.

Toner is the image-forming material in a developer which when deposited by the field of an electrostatic charge becomes the visible record. There are two main types of developing systems known as one-component and two-component systems. In one-component developing systems, the developer material is toner made of particles of magnetic material, usually iron, embedded in a pigmented thermoplastic resin. The iron enables the toner to be magnetically manipulated, for example, in development and cleaning processes. In two-component systems, the developer material is comprised of toner comprising small thermoplastic resin particles and a color agent, and carrier granules comprising roughly spherical particles or beads made of, for example, hard or soft magnetically susceptible materials, such as steel.

The following U.S. Patents are noted.

U.S. Pat. No. 4,932,355 Patentee: Neufeld Issued: Jun. 12, 1990

U.S. Pat. No. 5,404,198 Patentee: Noda et al. Issued: Apr. 4, 1995

Portions of the foregoing patent may be briefly summarized as follows:

U.S. Pat. No. 4,932,355 discloses a method for removing a developer mix from a developing station with a magnetic closing device that is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

U.S. Pat. No. 5,404,198, discloses a process cartridge mountable to an image forming apparatus an includes a frame, an image bearing member, a toner carrying member for directing toner to the image bearing member, and a magnet disposed within the toner carrying member. A common positioning member, separate from the frame, contacts each of the image bearing member and the magnet to mutually position the image bearing member and the magnet.

The disclosures of the aforementioned documents are totally incorporated herein by reference.

There exists a need for an apparatus and processes thereof for filling a container with developing material and non invasively mixing the container contents.

There remains a need for a material filling, particle distribution, and component dispersion system for magnetic two component developers which provides predispersion of carrier granules in a developer container or cartridge during manufacture, and which system enables improved developer image performance upon dispensing in an imaging apparatus.

There also remains a need for processes for non invasively mixing or agitating the contents of a developer cartridge or container to obtain homogeneous developer mixtures during post container filling operations.

Solutions to the above problems and needs have been achieved, in embodiments of the present invention, wherein there is provided apparatus and processes for filling developer cartridges, and simultaneously or subsequently non invasively magnetically mixing the container contents to produce superior dispersions of mixtures of developer components compared to developers and cartridges filled and mixed by conventional non magnetic processes.

SUMMARY OF THE INVENTION

Examples of objects of the present invention, in embodiments, include:

overcoming or minimizing problems encountered in the art by providing developer filling and mixing equipment, which enables improved manufacturing efficiency and material throughput;

providing filling and non invasive mixing processes which enable superior performing developer materials; and providing apparatus and processes for readily and economically filling containers with developer materials and simultaneously or subsequently, non invasively, mixing or agitating the container contents.

These and other objects are achieved, in embodiments, of the present invention as described and illustrated herein.

In embodiments, the present invention provides, processes for filling and dispersing the contents of a container, comprising: placing a container to be filled in filling relationship with a container holder and at least one material source; moving a magnetic material from a first source to the container to fill the container with the magnetic material, and applying a magnetic field to the container; moving a non magnetic material from a second source to the container to further fill the container with the non magnetic material; and removing the magnetic field applied to the container prior to discharging the filled material.

In accordance with embodiments of the present invention, there is provided processes for dispersing the contents of a container, comprising: placing in close proximity, to a filled container containing at least one particulate magnetic material and an a non magnetic material, at least one magnetic field; and changing the relative positional relationship of the magnetic field and the filled container so that the magnetic field acting on the magnetic particulate material in the container provides a non invasive agitation and dispersion to said magnetic material thereby admixing the magnetic component and the non magnetic material.

Pursuant to other embodiments of the present invention, there is provided an apparatus for filling a container and mixing the contents of the filled container, comprising: means for placing a container in filling relationship to a fill tube; means for moving a magnetic material from a source through the fill tube to the container to fill the container with magnetic material; means for applying a magnetic field to the magnetic material in the container; means for moving a non magnetic material from a source through the fill tube to fill the container with non magnetic material; means for moving the container; and means for removing the magnetic field applied to the container so that the magnetic and non magnetic materials intimately mix.

Other embodiments of the present invention provide an apparatus for mixing the contents of container, comprising: a conveyor for conveying a filled container; at least one magnetic element located adjacent to the container, the magnet element supplying a magnetic field to the magnetic contents of the container, wherein the magnetic field is sufficient to suspend magnetic contents from the bottom of the container and to prevent settling of the magnetic contents; and optionally means for varying the strength of the magnetic field.

Yet another aspect of the present invention provides an apparatus for filling a container with a magnetic material and thereafter conveying the container from a first fill location to a second fill location to fill the container with non magnetic material, wherein the container contents are continuously or intermittently agitated with magnetic means to provide and ensure uniform, that is, homogenous, mixtures of developer components when the container leaves the second location.

The apparatus and processes of the present invention are useful in developer manufacture and packaging operations involving mixtures of particulate magnetic and non magnetic components, and related industrial processes.

The above and further objects and advantages of the present invention will be readily apparent from the following description of preferred embodiments taken in conjunction with the accompanying drawings.

Figure 1A:
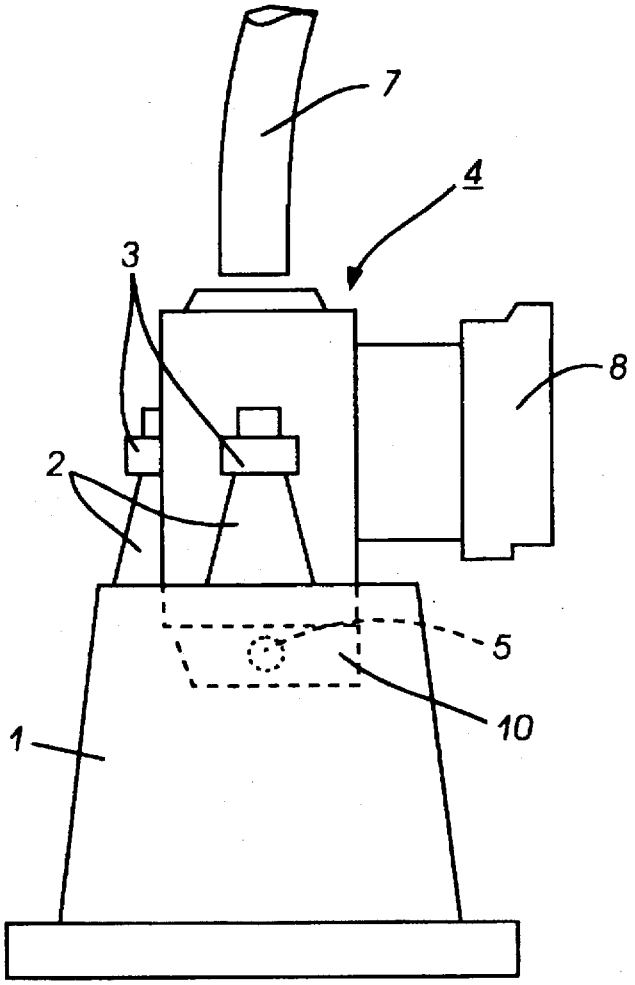
FIG. 1A shows in plan view, in embodiments of the present invention, a container and container holder or puck in proper filling relationship to a fill tube.

While the present invention will be described in connection with preferred embodiments thereof, it will be understood that it is not intended to limit the invention to those embodiments. On the contrary, the description is intended to cover all alternatives, modifications, and equivalents as may be included within the spirit and scope of the invention as defined by the appended claims.

DETAILED DESCRIPTION OF THE INVENTION

The present invention, in embodiments, is directed to processes for filling and dispersing the contents of a container, comprising: placing a container to be filled in filling relationship with a container holder and at least one material source; moving a magnetic material from a first source to the container to fill the container with the magnetic material, and applying a magnetic field to the container; moving a non magnetic material from a second source to the container to further fill the container with the non magnetic material; and removing the magnetic field applied to the container prior to discharging the filled material In embodiments, the present invention is directed to processes for dispersing the contents of a container, comprising: placing in close proximity, to a filled container containing at least one particulate magnetic material and a non magnetic material, at least one magnetic field; and changing the relative positional relationship of the magnetic field and the filled container so that the magnetic field acting on the magnetic particulate material in the container provides a non invasive agitation and dispersion to the magnetic material thereby admixing the magnetic component and the non magnetic material.

In still other embodiments, the present invention is directed to an apparatus for filling container and mixing the contents of the filled container, comprising: means for placing a container in filling relationship to a fill tube; means for moving a magnetic material from a source through the fill tube to the container to fill the container with magnetic material; means for applying a magnetic field to the magnetic material in the container; means for moving a non magnetic material from a source through the fill tube to fill the container with non magnetic material; means for moving the container; and means for removing the magnetic field applied to the container so that the magnetic and non magnetic materials intimately mix.

The present invention, in embodiments, is directed to an apparatus for mixing the contents of container, comprising: a conveyor for conveying a filled container; at least one magnetic element located adjacent to the container, the magnet element supplying a magnetic field to the magnetic contents of the container, wherein the magnetic field is sufficient to suspend magnetic contents from the bottom of the container and to prevent settling of the magnetic contents; and optionally means for varying the strength of the magnetic field.

The present invention, in embodiments, provides an apparatus for filling a container with a magnetic material and thereafter conveying the container from a first fill location to a second fill location to fill the container with non magnetic material, wherein the container contents are continuously or intermittently agitated with magnetic means to provide and ensure uniform, that is, homogenous, mixtures of developer components when the container leaves the second location.

FIG. 1A shows in plan view, in embodiments of the present invention, a container in proper filling relationship to a fill tube wherein the tube end resides substantially at or within the container top side opening. A container support, such as a developer cartridge transport puck 1 can, in embodiments, have a plurality of support arms 2 projecting upward therefrom and are adapted with magnetic means 3, for example, permanent magnets or electromagnetically controlled magnetic means, and situated to accommodate a developer or toner cartridge 4 therein. A cartridge dispense hole 5 (hidden line circle) is plugged or suitably stoppered during typical filling of the cartridge. Cartridge filling is accomplished through an opening in the top of the cartridge and in communication with the material source (not shown) by the filler nozzle 7. The fill nozzle or tube is sized appropriately so that it is slightly smaller than the developer container filling opening (not shown) and enables maximal filling and minimal leakage or spillage of fill materials. The fill tube is preferably made of a non stick polymer material, for example, TEFLON, or stainless steel. Upon completion of individual or overall filling operations, the containers can be temporarily or permanently sealed at the filling opening depending upon post fill handling and usage requirements.

The cartridge or container 4 can be manipulated, for example, moved, transported, or positioned, before, during, and after filling with a handling means, for example a mechanical or robotic mechanism 8, or a conventional conveyor belt. In a comparative situation, in the absence of the influence of the aforementioned magnetic elements 3 located in the support arms 2 of the transport puck or holder 1, the magnetic fill material readily falls to the bottom 10 of the cartridge under gravity. In embodiments of the present invention, the magnetic fill material is substantially held off the floor of the container and substantially in close proximity to the walls of the container and wherein sufficient separation exists between the container inner wall and magnetically "active" fill material so that subsequently added non magnetic fill material can readily access, surround, and coat the magnetic fill material either directly or under mild non invasive magnetic agitation as described herein.

Figure 1B:
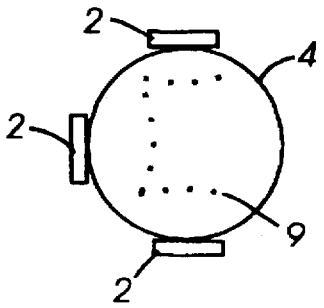
FIG. 1B shows in a top view, in embodiments of the present invention, the influence of external magnetic elements on the magnetic fill material in a container cartridge during a fill operation.

FIG. 1B shows in a top view, in embodiments of the present invention, the influence of magnetic elements, such as bar magnets or electromagnetic elements, situated in the support arms or elements 2 and adjacent to a cartridge container 4 on the magnetic fill material 9. The magnetic fill material 9 is substantially held in close proximity to the walls of the cartridge container while still allowing subsequently added non magnetic material to intimately access and mix with the magnetic fill material, and little or no magnetic material resides on the bottom of the cartridge container.

Figure 2:
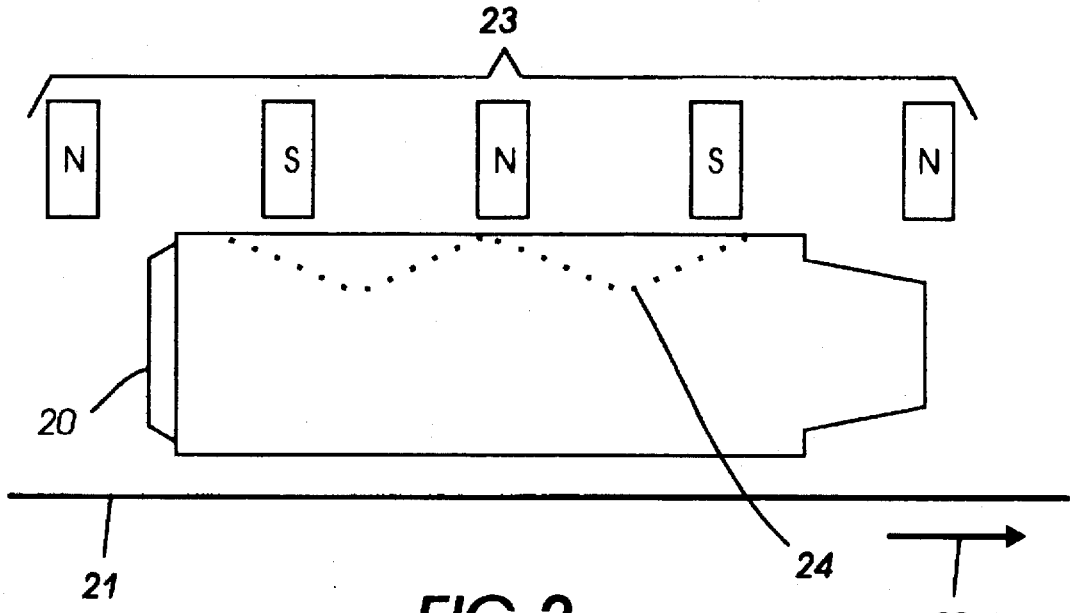
FIG. 2 shows a schematic, in embodiments of the present invention, of a developer container cartridge traveling on a conveyor means and illustrates the action of external and stationary magnetic elements on the magnetic developer component in the container cartridge.
Figure 3:
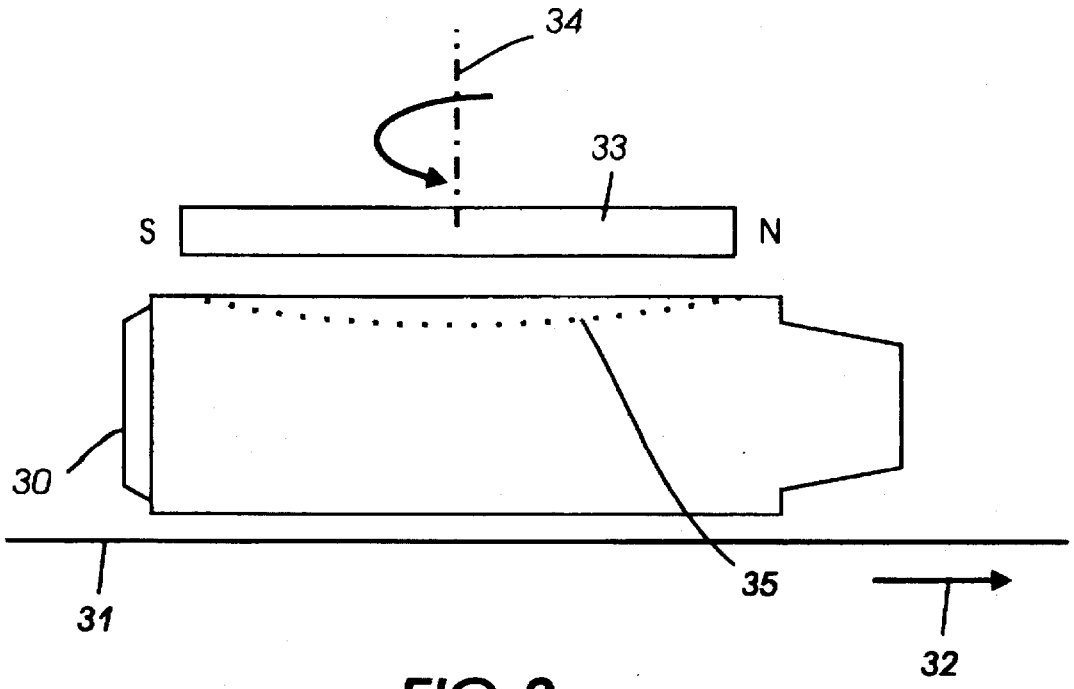
FIG. 3 shows a schematic, in embodiments of the present invention, of a developer container cartridge traveling on a conveyor means and illustrates the action of external and rotationary magnetic elements on the magnetic developer component in the container cartridge.

FIGS. 2 and 3, in embodiments, depict views of moving containers along an indexing conveyor relative to the fill tube. Each container is positioned in a carrying device, also known as a puck. Pucks are specially designed and built for each type of developer or toner container, the puck allowing for different container widths and heights. A puck is used so that the same conveying and lifting system can be used with dimensionally different developer and toner container types. When the container is in position under the fill tube an optional lifting mechanism (not shown) pushes the puck with the container in it upwards until the lifting mechanism is fully extended. When the lifting mechanism is fully extended, the container is in the proper filling relationship with the fill tube.

FIG. 2 shows a schematic, in embodiments of the present invention, of a developer container cartridge 20 traveling on a conveyor means 21 and illustrates the action of a plurality, for example from 2 to about 10,000, of external and stationary magnets 23, for example, with alternating polarities, on the magnetic developer component 24 in the container cartridge 20. In other embodiments, the magnetic polarities need not alternate and can be the same polarities, so that as long as the container is in motion, adequate fill material mixing and agitation is achieved.

FIG. 3 shows a schematic, in embodiments of the present invention, of a developer container cartridge 30 traveling directionally 32 on a conveyor means 31 and illustrates the action of externally and axially rotating 34 magnetic dipole element 33, such as a bar magnet or electromagnet, on the magnetic developer component 35 in the container cartridge. In embodiments, an alternating current electromagnetic means where the poles of the magnetic component(s) may be readily interchanged is a suitable equivalent alternative to the aforementioned alternating and stationary magnetic means 23 and the rotating magnetic 33.

In embodiments of the present invention, there is provided a filling and mixing apparatus and processes thereof which provides for economical and readily implemented techniques for conveniently controlling toner emissions, for example, in manufacturing, packaging, shipping, dispensing, and the like handling or unit operations.

In embodiments of the present invention, there is provided a process for filling and dispersing the contents of a container, comprising: placing a container to be filled in filling relationship with a container holder and at least one material source; moving a magnetic material from a first source to the container to fill the container with the magnetic material, and applying a magnetic field to the container; moving a non magnetic material from a second source to the container to further fill the container with the non magnetic material; and removing the magnetic field applied to the container prior to discharging the filled material. In embodiments, the magnetic field is sufficient to hold the magnetic material within the container substantially against or in close proximity to the container walls. Applying a magnetic field to the container, is accomplished prior to, simultaneously, or subsequent to filling with material. In embodiments, the magnetic field application is preferably accomplished prior to the fill of the first material component, typically the magnetic material component. With respect to the container and the container holder, they can be constructed of any suitable material so that the objects of the invention are achieved. The container is preferably constructed of a non magnetic material, such as a polyethylene or polycarbonate polymer. If a container holder is selected to support the container, the container holder can be configured with at least one vertical support member wherein the support member is substantially magnetic or has magnetic means attached thereto, or embedded therein, to render the support arm substantially magnetic with respect to the magnetic fill material in the container.

In embodiments, the container can be filled with magnetic material in an amount of from about 2 to about 95 weight percent and thereafter filled with non magnetic material in an amount of from about 98 to about 5 weight percent based on the total weight of the container contents. In embodiments, the magnetic material can be magnetic toner particles and the non magnetic material can be non magnetic toner particles, reference for example, U.S. Pat. No. 5,475,470 which discloses development processes wherein a mixture of magnetic and non magnetic toners may reside and be separately dispensed from the same developer housing. The aforementioned fill materials are preferably any suitably magnetic xerographic carrier granules and non magnetic toner particles, respectively, and are present in the container in a weight amount ratio of from about 75:25 to about 90:10.

The magnetic fill material can have magnetic properties selected from magnetic, paramagnetic, superparamagnetic, diamagnetic particles, and the like materials, and mixtures thereof. The magnetic material can have a volume average particle size of from about 20 to about 10,000 microns, and in embodiments, preferably in the range of from about 30 to about 1,000 microns.

The magnet member or means associated with either the puck holder, or the magnetic array about the conveyor, can be a permanent or electrically induced magnet, and combinations thereof.

The terms "permanent magnet", "bar magnet", and "electromagnet" refer to any material which exhibits magnetic properties; can be of any geometry and size; and can exert a sufficient magnetic field on the magnetic fill material in the container to accomplish the objects of the present invention.

In embodiments, the application of a magnetic field can be accomplished by, for example, placing an electromagnetic coil or a bar magnet or bar magnet array in close proximity, above, below, or around the container holder. Suitable application of magnetic provides a magnetic field sufficient to "activate" the magnetic particles in the container, that is, to suspend and or orient the magnetically susceptible particles in the container prior to the addition of, or in admixture with, non magnetic particles.

In embodiments, after removal of the applied magnetic field, if desired, although believed to be unnecessary for most applications, a demagnetizing field may be applied to the fill material so that the bulk of the fill material is partially or completely demagnetized, either to facilitate handling or to return the magnetic material component to its original, a lessor, or non magnetic state.

The amount of toner loaded in the container can be predetermined by various means, for example, based on the size of the container and the toner flow, and is mainly controlled by known source dispensing means, such as, the number of rotations of a feed auger, reference for example, the aforementioned commonly owned copending application, U.S. Ser. No. 08/1540,993 (D/95051), which discloses a method for controlling filling a container.

In process embodiments for dispersing the contents of a container, changing the relative positional relationship of the magnetic field and the filled container is accomplished so that the magnetic field acting on the magnetic particulate material in the container provides a non invasive agitation and dispersion to the magnetic material thereby efficiently admixing the magnetic component and the non magnetic material in the container, for example, by rotating the external magnetic field, by moving the container with a conveyor belt, or by simultaneously moving the container and moving the external magnetic field, and as illustrated in FIG. 3. The magnetic field employed can be provided by, for example, a series of bar magnets with alternating pole orientations, a rotating bar magnetic, a magnetic coil surrounding the container, and the like magnetic means.

In preferred embodiments, the magnetic field applied to the container is removed prior to discharging the filled material from the container.

As in the aforementioned filling embodiments, the magnetic field used to mix the contents of the partially or completely filled container is sufficiently strong to temporarily hold the magnetic material within the container substantially against or in close proximity to the container walls and thereby allow mixing and dispersion of the container contents. The magnetic field is of such strength to achieve the aforementioned suspension of magnetic particles but is of insufficient magnetic strength to cause misalignment or undesirable movement of the containers.

In embodiments of the aforementioned filling and mixing apparatuses, there may be selected, separately or in combination: magnetic materials which are suitable as xerographic carrier particles; non magnetic materials which are suitable as toner particles; means for moving the container such as a conveyor belt; means for applying a magnetic field to the magnetic material in the container such as a permanent magnet, an electromagnetic coil above or around the container, and electrically induced magnets.

In embodiments, when an apparatus for achieving high levels of mixing of the contents of a container is desired, at least one magnetic element is located adjacent to the container, wherein the magnetic element supplies a magnetic field to the magnetic contents of the container, and wherein the magnetic field is sufficient to suspend magnetic contents from the bottom of the container and to prevent settling of the magnetic contents. Optionally a means for varying the strength of the magnetic field may be employed to provide the capability to turn the magnetic field entirely off to release the suspended magnetic particles from their suspended state to a relaxed state to bring the magnetic component into close admixture with the non magnetic components. Alternatively, the means for varying the strength of the magnetic field can be used to produce enhanced non invasive agitation to both the magnetic and non magnetic contents in the container, for example, by either intermittent or continuous operation. For example, by providing a rapidly varying or pulsed magnetic field about the container, wherein the container is either stationary or in continuous motion, such as on a conveyor, highly dispersed mixtures of the magnetic and non magnetic components can be obtained.

A number of toner polymeric resins can be selected for toner compositions, for example, styrene-acrylates, styrene-methacrylates, styrene-butadienes and especially polyesters. The toner compositions may contain waxes so that fuser stripping failure is avoided or minimized.

The toner compositions usually contain pigment particles comprised of, for example, carbon black like REGAL 330® magnetites, or mixtures thereof, cyan, magenta, yellow, blue, green, red, or brown components, or mixtures thereof thereby providing for the development and generation of black and/or colored images.

When the pigment particles are comprised of magnetites, thereby enabling single component or two component magnetic toners in some instances, which magnetites are a mixture of iron oxides ($FeO \cdot Fe_2O_3$) including those commercially available as MAPICO BLACK®, they are present in the toner composition in an amount of from about 10 percent by weight to about 80 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Charge additive can also be included in the toner compositions and examples include those as illustrated in U.S. Pat. No. 4,338,390 which additives can impart a positive charge to the toner composition; the alkyl pyridinium compounds as disclosed in U.S. Pat. No. 4,298,672, and the charge control additives as illustrated in U.S. Pat. Nos. 3,944,493; 4,007,293; 4,079,014; 4,394,430, and 4,560,635, which illustrates a toner with a distearyl dimethyl ammonium methyl sulfate charge additive. Negative charge additives can also be selected, such as zinc or aluminum complexes, like an aluminum compound of a hydroxy carboxylic acid (BONTRON E-88® from Orient Chemical Company), the zinc complex of 3,5-ditertiary butyl salicylate (BONTRON E-84® from Orient Chemical Company) and hydroxy bis (3,5-ditertiary butyl salicylic) aluminate monohydrate, and the like compounds, and mixtures thereof.

There can be included in the toner and developer compositions low molecular weight waxes, or mixtures thereof, such as polypropylenes and polyethylenes such as EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 3000, such as those obtainable from Petrolite Corporation, while the commercially available polypropylenes optionally utilized for the toner compositions of the present invention are believed to have a molecular weight of from about 4,000 to about 5,000. Many of the polyethylene and polypropylene compositions are illustrated in British Patent No. 1,442,835. The low molecular weight wax materials are present in the toner in various amounts, however, generally these waxes are present in the toner composition in an amount of from about 1 percent by weight to about 15 percent by weight, and preferably in an amount of from about 2 percent by weight to about 10 percent by weight.

There can also be blended with the toner compositions other toner additives, such as external additive particles including flow aid additives, which additives are usually present on the surface thereof. Examples of these additives include metal oxides, such as aluminum oxide, titanium oxide, tin oxide, cerium oxide mixtures thereof, and the like, colloidal fumed silicas, such as AEROSIL®, or CABOSIL®, metal salts and metal salts of fatty acids including zinc stearate, magnesium stearate, polymeric particles of from 0.2 to 5 microns such as polyvinylidene fluoride which is obtainable from ATOCHEM North America, Inc., polytetrafluoroethylene available from ICI Advanced Materials, or polymeric microspheres of from 0.1 to 2.0 microns, such as those obtainable from Nippon Paint, Osaka, Japan, and mixtures thereof, which additives are generally present in an amount of from about 0.1 percent by weight to about 5 percent by weight, and preferably in an amount of from about 0.1 percent by weight to about 3 percent by weight. Several of the aforementioned additives are illustrated in U.S. Pat. Nos. 3,590,000 and 3,800,588.

With further respect to toner surface additives, colloidal silicas, such as AEROSIL®, can be surface treated with known charge additives, such as DDAMS, in an amount of from about 1 to about 30 weight percent and preferably 10 weight percent, followed by the addition thereof to the toner in an amount of from 0.1 to 10, and preferably 0.1 to 1 weight percent.

Suitable magnetic and non magnetic fill materials of the present invention include colored toners and developer compositions comprised of toner resin particles, and carrier particles, and as pigments or colorants red, blue, green, brown, magenta, cyan and/or yellow particles, as well as mixtures thereof. Colored pigment particles are present in the toner composition in an amount of from about 2 percent by weight to about 15 percent by weight calculated on the weight of the toner resin particles.

For the formulation of developer compositions, the toner particles are non invasively mixed with the carrier components during filling and subsequent transfer operations under the influence of the external magnetic means and as illustrated herein.

Carrier particles are selected to be of a negative or positive polarity enabling the toner particles, which are preferably oppositely charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604. The selected carrier particles can be used with or without a coating, the coating generally containing terpolymers of styrene, methylmethacrylate, and a silane, such as triethoxy silane, reference U.S. Pat. Nos. 3,526,533 and 3,467,634; polymethyl methacrylates; and other known coatings. The carrier particles may also include in the coating, which coating can be present in embodiments in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. No. 4,937,166 and 4,935,326, including, for example, KYNAR® and polymethylmethacrylate mixtures in a ratio of 40/60. Coating weights can vary; generally, however, from about 0.3 to about 2, and preferably from about 0.5 to about 1.5 weight percent coating weight is selected.

The toner and developer compositions can be selected for use in electrostatographic imaging apparatuses containing therein conventional photoreceptors providing that they are capable of being charged negatively. Thus, the toner and developer compositions can be used with layered photoreceptors that are capable of being charged negatively, or positively, such as those described in U.S. Pat. No. 4,265,990. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner are usually jetted and classified subsequent to preparation to enable toner particles with a preferred average diameter of from about 5 to about 25 microns, and more preferably from about 6 to about 12 microns. Also, the toner compositions preferably possess a triboelectric charge of from about 5 to 40 microcoulombs per gram in embodiments thereof as determined by the known charge spectrograph, Admix time for the toners are preferably from about 15 seconds to 1 minute, and more specifically, from about 15 to about 30 seconds in embodiments thereof as determined by the known charge spectrograph, These toner compositions with rapid admix characteristics enable, for example, the development of latent electrostatographic images in electrophotographic imaging apparatuses, which developed images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

The toner and developer compositions possess excellent admix characteristics, and maintain their triboelectric charging characteristics for an extended number of imaging cycles, up to for example 1,000,000 in a number of embodiments. The toner and developer compositions of the present invention can be selected for electrophotographic, especially xerographic, imaging and printing processes, including color processes.

The aforementioned desired toner and developer characteristics, such as rapid admix, diminished background deposits, stable triboelectric charge, and the like properties, are believed to be, at least in part, attributable to the intimate mixing and dispersion afforded to the developer components in accordance with the apparatus and processes of the present invention.

The aforementioned patents and publications are incorporated by reference herein in their entirety.

Other modifications of the present invention may occur to those skilled in the art based upon a review of the present application and these modifications, including equivalents thereof, are intended to be included within the present invention.

What is claimed is:

1. A process for dispersing the contents of a container, comprising:

placing in close proximity, to a filled container containing at least one particulate magnetic material and a non magnetic material, at least one magnetic field; and changing the relative positional relationship of the magnetic field and the filled container so that the magnetic field acting on the magnetic particulate material in the container provides a non invasive agitation and dispersion to said magnetic material thereby admixing the magnetic component and the non magnetic material, wherein moving the container is accomplished with a conveyor belt, and wherein changing the relative position of the magnetic field and container is accomplished by moving the container on said conveyor.

2. A process in accordance with claim 1 wherein the magnetic field selected from the group consisting of at least one stationary or rotating bar magnet, a stationary or rotating electromagnetic coil, and combinations thereof.

3. A process in accordance with claim 1 wherein changing the relative position of the magnetic field and container is accomplished by rotating the external magnetic field.

4. A process in accordance with claim 1 wherein changing the relative position of the magnetic field and container is accomplished by simultaneously moving the container and moving the external magnetic field.

5. A process in accordance with claim 1 further comprising removing the magnetic field applied to the container prior to discharging the filled material.

6. A process in accordance with claim 1 wherein the magnetic field is sufficient to temporarily hold the magnetic material within the container substantially against or in close proximity to the container walls and thereby allow mixing and dispersion of the container contents.

7. A process in accordance with claim 1 wherein the container is non magnetic.

8. A process in accordance with claim 1 wherein the container is filled with magnetic material in an amount of from about 2 to about 95 weight percent and filled non magnetic material in an amount of from about 98 to about 5 weight percent based on the total weight of the container contents.

9. A process in accordance with claim 1 wherein the magnetic material comprises xerographic carrier bead particles and the non magnetic material comprises xerographic toner particles.

10. A process in accordance with claim 1 wherein the magnetic material comprises magnetic toner particles and the non magnetic material comprises non magnetic toner particles.

11. A process in accordance with claim 1 wherein the magnet field is selected from the group consisting permanent and electrically induced magnets, and combinations thereof.

12. A process in accordance with claim 1 wherein the application of the magnetic field is accomplished by placing an electromagnetic coil in close proximity, above or around, the container holder.

13. An apparatus for filling a container and mixing the filled contents thereof, comprising:

an elevating conveyor for placing a container in filling relationship to a fill tube;

a source and magnetic valve means for moving a magnetic material from the source through the fill tube to the container to fill the container with magnetic material;

at least one magnetic element for applying a magnetic field to the magnetic material in the container; and a second source and non magnetic valve means for moving a non magnetic material from the second source through the fill tube to fill the container with non magnetic material, wherein the container is conveyed on the conveyor and the filled magnetic and non magnetic materials intimately mix.

14. An apparatus in accordance with claim 13, wherein the magnetic material is carrier particles.

15. An apparatus in accordance with claim 13, wherein the non magnetic material is toner particles.

a magnetic field to the magnetic material in the container is selected from the group consisting a permanent magnet, an electromagnetic coil above or around the container, and electrically induced magnets, and combinations thereof.

16. An apparatus in accordance with claim 13, further comprising a means for controllably varying the strength and duration of said at least one magnetic element, so that a continuous or intermittent magnetic field can be applied to the container.

17. An apparatus for mixing the contents of a container, comprising:

a conveyor for conveying a filled container wherein the filled container contains magnetic contents;

at least one magnetic element located adjacent to the container, the magnetic element supplying a magnetic field to the filled container, and wherein the magnetic field is sufficient to suspend the magnetic contents from the bottom of the container and to prevent settling of the magnetic contents; and optionally varying the strength of the magnetic field by moving said magnetic element relative to the filled container.

* * * * *